United States Patent [19]

Fehrenbach

[11] Patent Number: 5,012,784

[45] Date of Patent: May 7, 1991

[54] PRESSURE REGULATOR DEVICE AND FUEL LINE RECEPTOR THEREFOR

[75] Inventor: Siegfried Fehrenbach, Markgroeningen, Fed. Rep. of Germany

[73] Assignee: Robert Bosch GmbH, Stuttgart, Fed. Rep. of Germany

[21] Appl. No.: 426,269

[22] Filed: Oct. 25, 1989

[30] Foreign Application Priority Data

Jan. 14, 1989 [DE] Fed. Rep. of Germany ..... 3900986

[51] Int. Cl.[5] ..... F02M 00/00

[52] U.S. Cl. ..... 123/463; 123/467; 137/510; 138/30

[58] Field of Search ..... 123/463, 456, 467, 460; 137/510; 251/396, 85, 87; 138/30, 31, 26, 39

[56] References Cited

U.S. PATENT DOCUMENTS

| | | | |
|---|---|---|---|
| 3,948,288 | 4/1976 | Mayer | 138/30 |
| 4,205,637 | 6/1980 | Ito | 123/456 |
| 4,436,112 | 3/1984 | Atkins | 137/510 |
| 4,664,142 | 5/1987 | Bertsch | 137/510 |
| 4,679,537 | 7/1987 | Fehrenbach | 123/447 |
| 4,741,315 | 5/1988 | Fehrenbach | 123/467 |
| 4,747,360 | 5/1988 | Affeldt et al. | 123/456 |
| 4,756,289 | 7/1988 | Rock | 123/467 |
| 4,825,835 | 5/1989 | DeWeerdt | 123/467 |

FOREIGN PATENT DOCUMENTS 2816479 10/1979 Fed. Rep. of Germany ..... 137/510

*Primary Examiner*—Carl Stuart Miller

*Attorney, Agent, or Firm*—Edwin E. Greigg; Ronald E. Greigg

[57] ABSTRACT

A pressure regulator device which enables greater coaxiality tolerances in the individual parts, without impairing the ability to assemble the parts or impairing a necessary tight sealing. The pressure regulator valve is disposed in a guide opening of a fuel distributor line and a receiving opening of an outlet connection. The pressure regulator valve has a bottom part and an outlet neck. An annular neck groove is embodied on the outlet neck and an annular housing groove is embodied on the bottom part. A sealing ring is disposed in each groove. The annular neck groove is defined by an outer shoulder and an inner shoulder, which has a smaller diameter than the outer shoulder. In the same way, the annular housing groove is defined by an outer shoulder and an inner shoulder, which has a smaller diameter than the outer shoulder. The outer shoulders of each groove allow centering of the pressure regulator valve while the inner shoulders allow concentricity errors. The pressure control device is applicable to fuel injection systems for internal combustion engines.

8 Claims, 1 Drawing Sheet

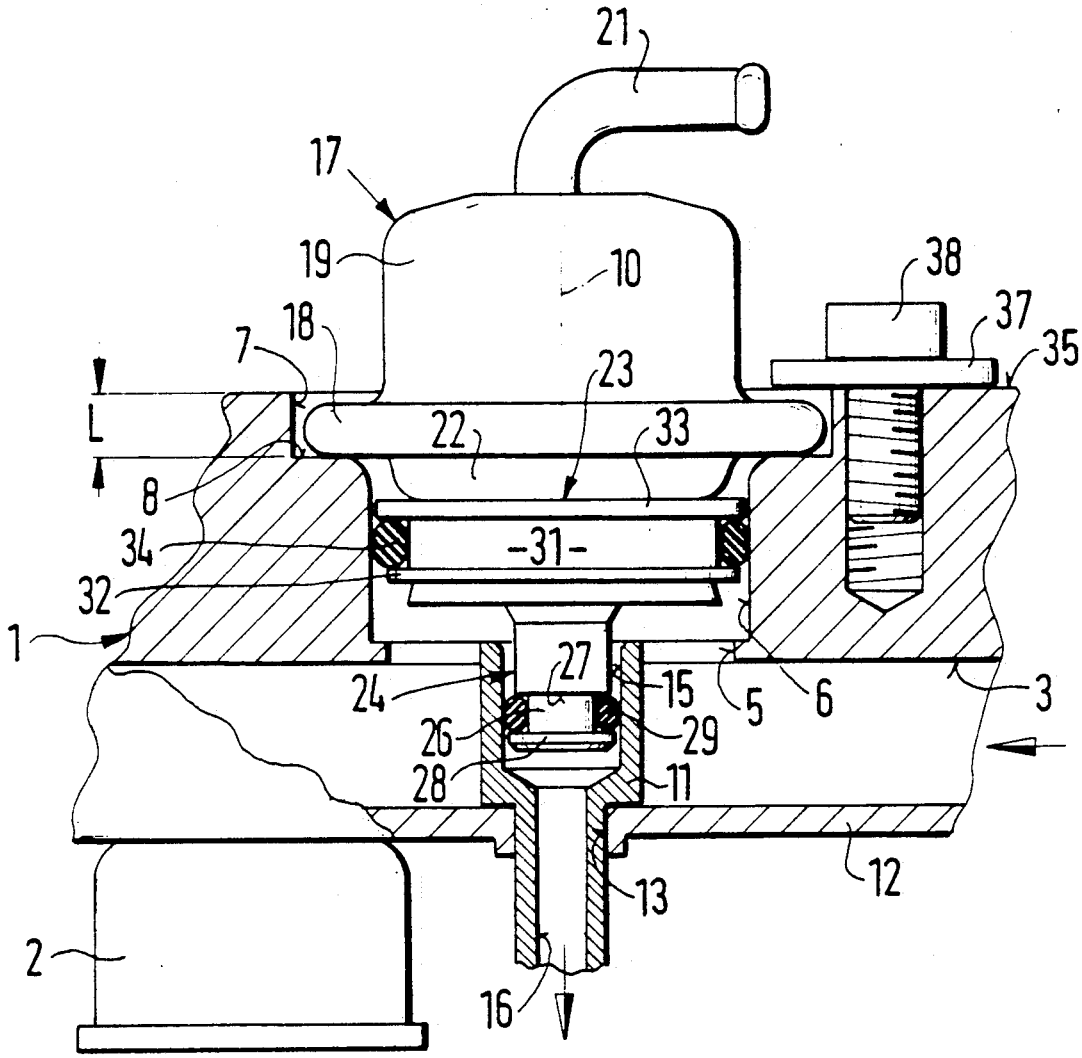
21
17
19
10
38
37
35
18
7
23
L
22
33
8
34
-31-
32
1
27
24
15
5
6
3
26
29
28
11
12
13
2
16

PRESSURE REGULATOR DEVICE AND FUEL LINE RECEPTOR THEREFOR

BACKGROUND OF THE INVENTION

The invention is based on a pressure regulator device as defined hereinafter. A pressure regulator device is already known (German Offenlegungsschrift 36 07 812, corresponding to U.S. Pat. No. 4,741,315), in which the pressure regulator valve and the fuel distributor line are each made up of various individual parts, and very small coaxial tolerances must be adhered to in the individual parts if the joining of the pressure regulator control valve and fuel distributor line is to be assured This undesirably increases the production costs for the known pressure regulator devices, because of these tolerance requirements.

OBJECT AND SUMMARY OF THE INVENTION

The pressure regulator device according to the invention ha a advantage over the prior art of enabling simpler, more-economical manufacture, since greater deviations and tolerances in coaxiality are now possible, and because a certain skewing of the pressure regulator valve relative to the guide opening in the fuel distributor line is permitted, without impairing the necessary sealing at the periphery of the pressure regulator valve.

In a particularly advantageous feature, the guide opening is disposed in the fuel distributor line, and a retaining opening is provided next to the guide opening; between the retaining opening and the guide opening, a support shoulder is formed, onto which an edge of the pressure regulator valve can be placed. The diameter of the retaining opening is enough larger than the diameter of the edge that there is some play between them. This prevents leakage at the periphery of the pressure regulator valve if the valve comes to be skewed as a result of deviations in coaxiality or external force of displacement. It is also advantageous to make the length of the retaining opening in the axial direction enough longer than the length of the edge in the axial direction that there is play between the edge and the end of the retaining opening in the axial direction as well, which again allows skewing without leakage.

The invention will be better understood and further objects and advantages thereof will become more apparent from the ensuing detailed description of a preferred embodiment taken in conjunction with the drawing.

BRIEF DESCRIPTION OF THE DRAWING

The sole figure of the drawing is a simplified view of an exemplary embodiment of the invention.

DESCRIPTION OF THE PREFERRED EMBODIMENT

In the drawing, a rigid fuel distributor line 1 is shown, made for instance of metal, for a fuel injection system for internal combustion engines. It has a plurality of plug-in connections 2, into which on end of fuel injection valves are inserted. Fuel is fed from a fuel feed pump, not shown, into a fuel distributor conduit 3 of the fuel distributor line 1, with which the various plug-in connections 2 communicate. At least one connecting opening 5 in the wall of the fuel distributor line 1 is open on one side toward the fuel distributor conduit 3 and o the other toward a guide opening 6 in the fuel distributor line 1. The guide opening could equally well be embodied in a holder bushing, as shown in German Offenlegungsschrift 36 07 812 corresponding to U.S. Pat. No. 4,741,315. Remote from the fuel distributor conduit 3, the guide opening 6 merges with a retaining opening 7, of larger diameter and a support shoulder 8 is formed between the guide opening 6 and the retaining opening 7. The retaining opening 7 is open to the atmosphere. An outlet connection 11 protrudes into the fuel distributor conduit 3 such that it is as well aligned as possible with the longitudinal axis 10 of the guide opening 6 and retaining opening 7, and penetrates the wall 12 of the fuel distributor line 1 remote from the guide opening 6 to enter a outlet opening 13 in which it is tightly secured, for instance by soldering. The outlet connection 11 may also be an integrally cast component of the fuel distributor line 1. Toward the guide opening 6, the outlet connection 11 has a receiving opening 15, which looking in the flow direction merges with an outlet conduit 16 of lesser diameter, which in a manner not shown leads to a fuel tank or to the intake side of the fuel feed pump.

A pressure regulator valve 17 of a known design, as shown for instance in German Utility Model G 88 01 816.4, is inserted partway into the retaining opening 7 and guide opening 6 in such a way that an enlarged diameter portion can be placed on the support shoulder 8 with an edge 18 formed by crimping or any other desired manner. Remote from the guide opening 6, the crimping of the edge 18 embraces a flange, not visible in the drawing, of a cap 19 of the pressure regulator valve 17, to which an air connection neck 21 is secured, by way of which, by means of a hose connection, not shown, a chamber in the interior of the pressure regulator valve 17 can be connected to the air intake tube of the engine downstream of a throttle valve. Remote from the cap 19, the crimping of the edge 18 embraces a flange, again not visible here, of an intermediate part 22, which is firmly connected to a bottom part 23 extending into the guide opening 6. An outlet neck 24 of smaller diameter is firmly joined to the bottom part 23 and protrudes in to the receiving opening 15 of the outlet connection 11. The fuel reaching the guide opening 6 from the fuel distributor conduit 3 via the at least one connecting opening 5 can flow into the pressure regulator valve 17, from which, at a pressure above the operating pressure, fuel can flow out of the pressure regulator valve via the outlet neck 24 into the outlet conduit 16. The outlet neck 24 is provided with an annular grove 26, which is defined in the axial direction by an inner shoulder 27 oriented toward the bottom part 23, on the one hand, and by an outer shoulder 28 remote from the bottom part 23, on the other. A first elastic sealing ring 29 that seals with respect to the receiving opening 15 is disposed in the annular groove 26 on the neck. The outer shoulder of the annular groove 26 of the neck is embodied as only slightly smaller in diameter than the diameter of the receiving opening and serves to center the outlet neck 24 in the receiving opening 15. According to the invention, the inner shoulder 27 of the annular groove 26 of the neck is embodied with a substantially smaller diameter than the outer shoulder 28 and thus is smaller than the receiving opening 15 as well, so that there is a large amount of play, or a gap, between the diameter of the inner shoulder 27 and the receiving opening 15. In the same way, the bottom part 23 is provided with an annular housing groove 31, which is defined in the axial direction on the one hand by an inner shoulder 32 oriented toward the outlet neck 24 and on the other by an outer shoulder 33 oriented toward the edge 18, and in which a second elastic sealing ring 34 is disposed which seals with respect to the guide opening 6. The outer shoulder 33 of the annular housing groove 31 is embodied with a diameter only slightly smaller than the guide opening 6, so that it serves to center the pressure control valve 17 in the guide opening 6. In contrast to this, the inner shoulder 32 of the annular housing groove 31 is embodied with a diameter substantially smaller than the diameter of the outer shoulder 33 and guide opening 6, so that there is a large amount of play, or a gap, between the inner shoulder 32 of the annular housing groove 31 and the guide opening 6. The embodiment of the inner shoulders 27, 32 with smaller diameters than the respective outer shoulders 38, 33 enables larger manufacturing tolerances not only in terms of the diameters of grooves 26 and 31, but also in terms of the coaxiality of the longitudinal axis 10, since any existing error in coaxiality will still not lead to leakage at the sealing rings 29, 34, but instead will merely cause certain skewing of the pressure regulator valve 17 relative to the longitudinal axis 10. The possibility of skewing of the pressure regulator valve 17 because of errors in coaxiality is also greater because the diameter of the retaining opening 7 is increased so much with respect to the diameter of the edge 18 that there is play or a gap, and the length L of the retaining opening in the axial direction is also so much greater than the length of the edge 18 in the axial direction that there is play or a gap between the edge 18 and the end of the retaining opening 7 at a side wall 35 of the fuel distributor line 1.

The axial displaceability of the pressure regulator valve 17 in the guide opening 6 or receiving opening 15 is limited for example by at least one retaining disk 37, protruding partway past the retaining opening 7 that extends in the plane of the side wall 35 and is secured to the fuel distributor line 1 by a screw 38. A plurality of retaining disks 37 may be provided, spaced apart from one another. Instead of the retaining disk 37, a resilient element may instead urge the pressure control valve 17 toward the guide opening 6.

The foregoing relates to preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A pressure regulator valve which is separate from and disposable on a rigid fuel distributor line for supplying fuel to fuel injection valves of a fuel injection system connected thereto for internal combustion engines, the pressure regulator valve includes a protruding outlet neck (24) which protrudes into a receiving opening (15) of an outlet connection (11) of the fuel distributor line, said regulator valve includes a bottom part (23) adjoining the outlet neck which protrudes into a guide opening (6), said outlet neck (24) includes an annular neck groove (26) defined in an axial direction by an outer shoulder (28), and by an inner shoulder (27) oriented toward said bottom part (23), said bottom part includes an annular housing groove (31) defined in an axial direction by an inner shoulder (32) oriented toward the outlet neck and by an outer shoulder (33), first elastic sealing ring (29) effecting sealing with respect to the receiving opening 15 is disposable in the annular neck groove (26), and a second elastic sealing ring (34) effecting sealing with respect to the guide opening is disposable in the annular housing groove (31), said inner shoulder (27) defining the annular neck groove (26) has a smaller diameter than the outer shoulder (28) thereof, and the inner shoulder (32) defining the annular housing groove (31) has a smaller diameter than its outer shoulder (33).

2. A pressure regulator valve and fuel distributor line receptor for receiving and securing the pressure regulator valve on a rigid fuel distributor line for supplying fuel to fuel injection valves of a fuel injection system connected thereto for internal combustion engines, said receptor including a connection opening (5) and an oppositely disposed smaller diameter outlet opening (13) in said rigid fuel distributor line, a guide opening (6) extending from said connection opening (5) and having the same or a larger diameter than said connection opening, an outlet connection (11), said outlet connection (11) having a receiving opening (15) and a portion extending through said outlet connection (13) that has an outlet opening (16), the pressure regulator valve includes a protruding outlet neck (24) which protrudes into said receiving opening (15) of said outlet connection (11), a bottom part (23) adjoining the outlet neck (24) which protrudes into said guide opening (6) of said receptor, said outlet neck includes an annular neck groove (26) defined in an axial direction by an outer shoulder (28), and by an inner shoulder (27) oriented toward said bottom part (23), said bottom part includes an annular housing groove (31) defined in an axial direction by an inner shoulder (32) oriented toward the outlet neck (24) and by an outer shoulder (33), a first elastic sealing ring (29) effecting sealing with respect to the receiving opening (15) is disposed in the annular neck groove (26), and a second elastic sealing ring (34) effecting sealing with respect to the guide opening (6) is disposed in the annular housing groove (31), and said inner shoulder (27) defining the annular neck groove (26) has a smaller diameter than the outer shoulder (28) thereof, and the inner shoulder (32) defining the annular housing groove (31) has a smaller diameter than its outer shoulder (33) whereby said pressure regulator valve may be skewed off axis with a good seal against leakage.

3. A pressure control valve as defined by claim 1, in which said guide opening (6) is embodied as a portion of said fuel distributor line (1).

4. A pressure regulator valve and fuel distributor line receptor as defined by claim 2, in which remote from said outlet connection (11), said guide opening (6) is adjoined by a retaining opening (7) having a larger diameter than said guide opening (6) and a support shoulder (8) formed between said guide opening (6) and the retaining opening (7), said pressure regulator includes an edge (18) which is placed on said support shoulder wherein the diameter of the retaining opening (7) is enough larger than the diameter of the edge (18) that play exists between the edge (18) and the retaining opening (7).

5. A pressure regulator valve and fuel distributor line receptor as defined by claim 3, in which remote from said outlet connection (11), said guide opening (6) is adjoined by a retaining opening (7) having a larger diameter than said guide opening (6) and a support shoulder (8) formed between said guide opening (6) and the retaining opening (7), said pressure regulator includes an edge (18) which is placed on said support shoulder wherein the diameter or the retaining opening (7) is enough larger than the diameter of the edge (18)

that play exists between the edge (18) and the retaining opening (7).

6. A pressure regulator valve and fuel distributor line receptor as defined by claim 4, in which a length (L) of said retaining opening (7) in an axial direction is enough larger than a length of said edge (18) in the axial direction that there is play in the axial direction between the edge (18) and a side wall (35) of the retaining opening (7).

7. A pressure regulator valve and fuel distributor line receptor as defined by claim 5, in which a length (L) of said retaining opening (7) in an axial direction is enough larger than a length of said edge (18) in the axial direction that there is play in the axial direction between the edge (18) and a side wall (35) of the retaining opening (7).

8. A pressure regulator valve and fuel distributor line receptor as defined by claim 1, in which remote from said outlet connection (11), said guide opening (6) is adjoined by a retaining opening (7) having a larger diameter than said guide opening (6) and a support shoulder (8) formed between said guide opening (6) and the retaining opening (7), said pressure regulator includes an edge (18) which is placed on said support should wherein the diameter of the retaining opening (7) is enough larger than the diameter of the edge (18) that play exists between the edge (18) and the retaining opening (7).

* * * * *